US006179173B1

(12) United States Patent
Frazier et al.

(10) Patent No.: US 6,179,173 B1
(45) Date of Patent: Jan. 30, 2001

(54) BIB SPOUT WITH EVACUATION CHANNELS

(75) Inventors: Steven G. Frazier, Stockbridge; Hsar Hmun, Norcross; Walter V. Sweet, Roswell, all of GA (US)

(73) Assignee: The Coca-Cola Company, Atlanta, GA (US)

( * ) Notice: Under 35 U.S.C. 154(b), the term of this patent shall be extended for 0 days.

(21) Appl. No.: 09/183,089

(22) Filed: Oct. 30, 1998

(51) Int. Cl.[7] ..... B65D 77/06

(52) U.S. Cl. ..... 222/573; 222/92; 222/105; 222/566; 383/906

(58) Field of Search ..... 222/92, 105, 107, 222/566, 572, 573; 383/33, 906

(56) References Cited

U.S. PATENT DOCUMENTS

| | | | | |
|---|---|---|---|---|
| 2,008,564 | * | 7/1935 | Schumacher | 222/566 |
| 3,690,524 | * | 9/1972 | Haberhauer | 222/573 |
| 4,601,410 | | 7/1986 | Bond | 222/92 |
| 4,893,731 | | 1/1990 | Richter | 222/92 |
| 4,913,316 | | 4/1990 | Richter | 221/1 |
| 4,998,990 | | 3/1991 | Richter et al. | 222/92 |
| 5,147,071 | | 9/1992 | Rutter et al. | 222/92 |
| 5,566,851 | * | 10/1996 | Sasaki et al. | 222/105 |
| 5,743,435 | | 4/1998 | Tomic | 222/105 |
| 5,749,493 | | 5/1998 | Boone et al. | 222/105 |

FOREIGN PATENT DOCUMENTS

| | | |
|---|---|---|
| WO 85/04383 | 10/1985 | (WO) . |
| WO 86/00868 | 2/1986 | (WO) . |

OTHER PUBLICATIONS

Marks' Standard Handbook for Mechanical Engineers, Baumeister et al., pp. 8–182 to 8–186, 1978.*

* cited by examiner

*Primary Examiner*—J. Casimer Jacyna
(74) *Attorney, Agent, or Firm*—Sutherland Asbill & Brennan LLP

(57) ABSTRACT

A spout for a wall of a flexible pouch. The spout includes a substantially hollow tube and a flange surrounding the tube. The flange includes a plurality of channels so as to provide a plurality of fluid passageways through the spout.

20 Claims, 3 Drawing Sheets

BIB SPOUT WITH EVACUATION CHANNELS

RELATED APPLICATIONS

Application Ser. No. 09/089,151, filed Jun. 2, 1998, entitled "A Disposable Liquid Containing And Dispensing Package And An Apparatus For Its Manufacture", is attached hereto as Appendix A. Application Ser. No. 09/089,151 also incorporates by reference two additional pending patent applications, application Ser. No. 09/041,609, filed Mar. 13, 1998, entitled "Method And Apparatus For Manufacturing A Fluid Pouch" and application Ser. No. 08/926,116, filed Sep. 9, 1997, entitled "A Disposable Liquid Containing And Dispensing Package And Method For Its Manufacture." All of these applications are assigned to The Coca-Cola Company, the assignee of the present application. These applications are incorporated herein by reference.

If any or all of these applications are allowed, then Appendix A will be canceled, in full or in part, and reference to the allowed subject matter will be substituted as provided by MPEP Section 608.01(p). If any or all of these applications are not allowed or are abandoned, then such subject matter will be incorporated into the specification of this application by amendment.

TECHNICAL FIELD

The present invention relates to a bag for a bag-in-box ("BIB") type package, and more particularly relates to a spout with evacuation channels formed therein for use in a BIB package.

BACKGROUND OF THE INVENTION

BIB packages are well known for containing and dispensing liquids such as syrup for post-mix soft drink dispensers. Such known packages include an outer protective and supporting box and an inner collapsible bag containing the syrup. The box is generally made of corrugated cardboard and the bag is generally made of a flexible plastic. The plastic bag has a spout for feeding the syrup to the post-mix beverage dispenser via a hose and a pump. A plastic dip strip or dip tube is often included within the bag to assist in withdrawing the syrup. The dip strip prevents the bag from collapsing upon itself while the syrup is being withdrawn and provides a fluid passageway to the spout from the far reaches of the bag.

An example of a bag-in-box bag with a ribbed dip strip therein is shown in U.S. Pat. No. 5,749,493 to Boone, et al., owned by The Coca-Cola Company, the assignee of the present invention. This reference describes, among other things, a ribbed dip strip sealed between the upper and lower bag walls at the top and bottom ends. The ribbed dip strip largely prevents the bag from collapsing upon itself and also provides the fluid passageway to the spout. The positioning of the dip strip apart from the spout also permits high speed filling. U.S. Pat. No. 5,749,493 is incorporated herein by reference. Similarly, the pending applications referenced above also describe, among other things, various types of bags for bag-in-box type packages using a ribbed dip strip and various methods for their use and manufacture.

In addition to the use of a dip strip to provide a fluid passageway to the spout, other known references use a raised spout to ensure access to and through the spout. For example, commonly-owned U.S. Pat. No. 4,998,990 to Richter, et al., shows a spout with a series of fins or vertical ribs positioned within the aperture that are used with one or more open channels to provide a fluid passageway. These fins or ribs are used to provide a certain amount of clearance between the spout and either the dip strip or the lower bag wall. This clearance allows the bag to be evacuated even as the upper and lower bag walls are collapsing upon themselves as the bag is being emptied. The raised spout design, however, adds extra bulk and materials to the bag as a whole. U.S. Pat. No. 4,998,990 is incorporated herein by reference.

What is needed, therefore, is a spout design that provides an adequate fluid passageway without the use of the extra material and the extra height associated with the raised spout or similar designs. The passageway should be operable while the bag is collapsing and otherwise and should communicate with the dip strip. Further, there is a need for a spout design that provides a plurality of fluid passageways to the aperture of the spout regardless of the orientation or position of the bag. Such a spout must provide the plurality of fluid passageways with a minimum of material and cost.

SUMMARY OF THE INVENTION

The present invention provides a spout for a wall of a flexible pouch. The spout includes a substantially hollow tube and a flange surrounding the tube. The flange includes a plurality of channels so as to provide a plurality of fluid passageways in communication with the substantially hollow tube.

Specific embodiments include attaching the flange to the wall of the flexible pouch along the first side of the flange and positioning the plurality of channels along the second side of the flange. The flange itself is positioned at the bottom end of said tube. Each of the plurality of channels extends radially from the outer diameter to the inner diameter of the flange and is spaced equidistantly thereon. The channels are formed within the flange. If the flange has a thickness of about 0.060 inches, the channels may have a depth of about 0.030 inches. Approximately thirty (30) channels may be used. The flange is generally made from a thermoplastic material.

A bag for a bag-in-box package may have a first and a second bag wall with a dip strip positioned therebetween. The spout is positioned on the first bag wall. The spout includes a radially extending flange and a plurality of channels so as to provide a plurality of fluid passageways. The dip strip includes a plurality of ribs thereon with the channels of the flange facing the ribs so as to cooperate in forming the fluid passageways.

It is thus an object of the present invention to provide an improved bag for a bag-in-box package.

It is another object of the present invention to provide an improved spout for a bag-in-box package.

It is yet another object of the present invention to provide a spout with evacuation channels formed therein for use in a bag-in-box package.

It is a further object of the present invention to provide a spout for a bag in a bag-in-box package that cooperates with a ribbed dip strip to provide a plurality of fluid passageways.

It is a still further object of the present invention to provide a spout for a bag in a bag-in-box package with superior evacuation capability.

Other objects, features, and advantages of the present invention will become apparent upon review of the following detailed description of the preferred embodiments of the invention, when taken in conjunction with the drawings and the appended claims.

DETAILED DESCRIPTION OF THE INVENTION

Figure 1:
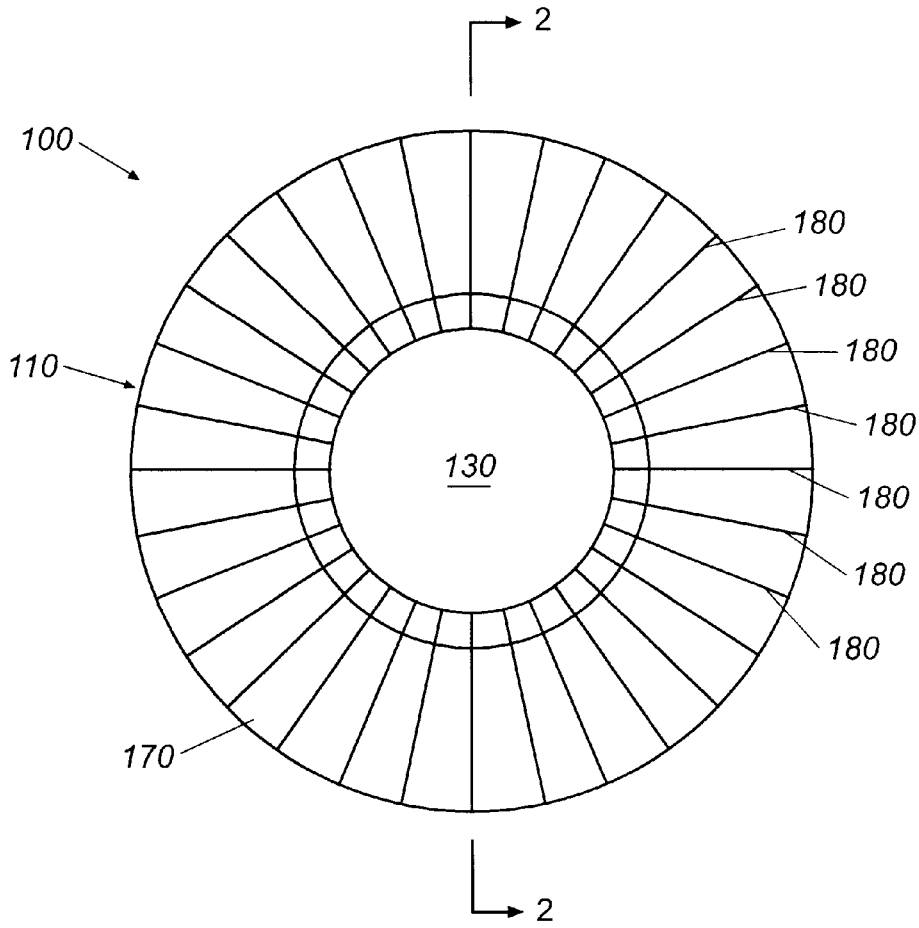
FIG. 1 is a plan view of the spout of the present invention showing the evacuation channels.
Figure 2:
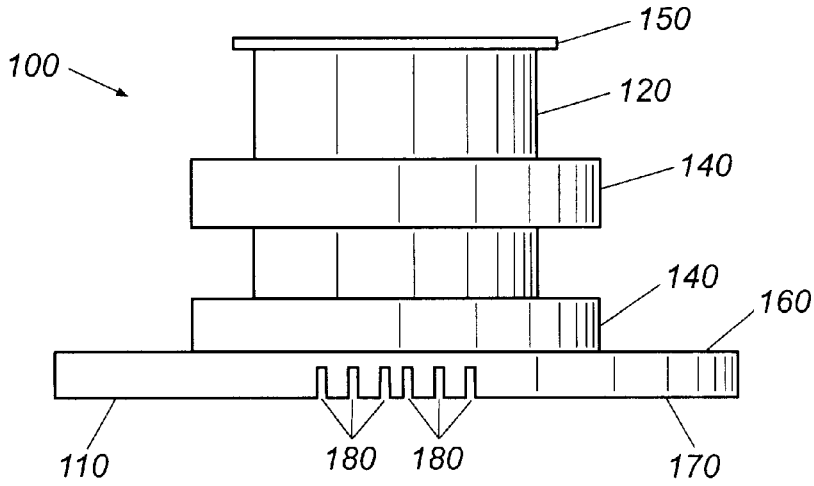
FIG. 2 is a cross-sectional view of the spout taken along line 2—2 of FIG. 1.

Referring now in more detail to the drawings, in which like numerals refer to like parts throughout the several views, FIGS. 1 and 2 show a spout 100 of the present invention. The spout 100 includes an extended flange 110 surrounding the lower portion of a vertically extending tube 120. The tube 120 is substantially hollow and creates an aperture 130. The spout 110 further includes one or more mounting flanges 140 surrounding the tube 120. The mounting flanges 140 are used to convey the spout 100 to the proper fill position in the filling process (not shown). The spout 100 may further include an upper lip 150.

The flange 110 includes a top side 160 and a bottom side 170. The top side 160 is generally flat and smooth. The bottom side 170 includes a plurality of evacuation channels 180 formed therein. The evacuation channels 180 may be of any functional thickness. By way of example, the evacuation channels 180 may be approximately 0.030 inches deep in a flange 110 of approximately 0.060 inches thick. Although FIG. 1 shows the evacuation channels 180 formed within the flange 110, the evacuation channels 180 also could be formed by a series of raised ribs or by other conventional means that provide a fluid passageway to the aperture 130.

Each of the evacuation channels 180 extends radially from the outer edge or the outer diameter of the flange 110 towards the aperture 130 or the inner diameter. The evacuation channels 180 generally surround the aperture 130. Any number of evacuation channels 180 may be used. For example, approximately thirty (30) equally spaced evacuation channels 180 may be used in a flange 110 of approximately two and one-half inches (2½") in diameter.

The spout 100 is generally manufactured from a thermoplastic material, including PET (polyethylene terephthalate), low density polyethylene, linear low density polyethylene, polypropylene, or other types of substantially rigid plastics. The spout 100 is preferably injection molded, but also can be manufactured by stamping or other conventional types of plastic manufacturing known to those skilled in the art. Although the spout 100 is preferably a unitary piece, the flange 110, the tube 120, the mating flanges 140, and the lip 150 could be manufactured separately and physically attached by conventional means fastening means.

Figure 3:
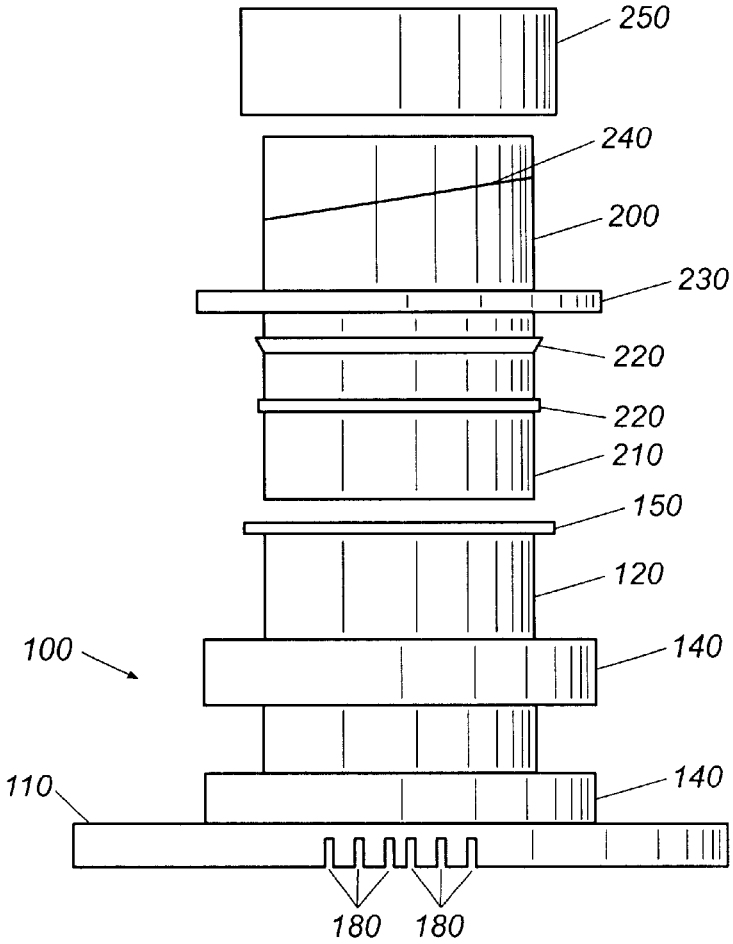
FIG. 3 is a cross-sectional view of the spout along with a drainage valve and a cap.
Figure 4:
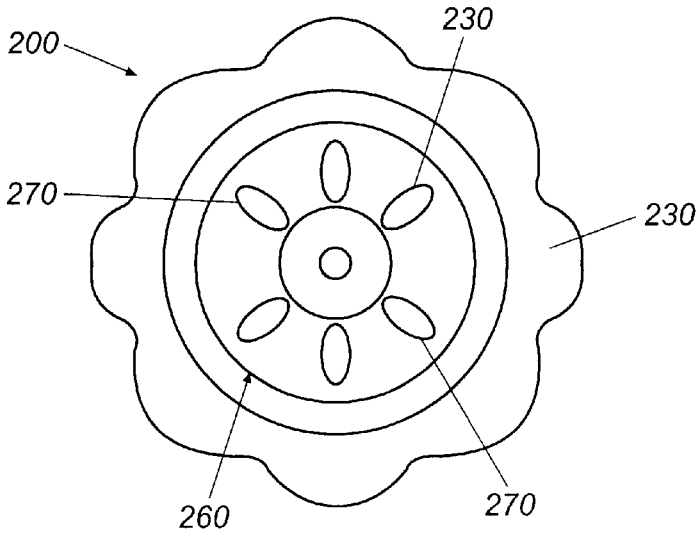
FIG. 4 is a plan view of the drainage valve.

FIGS. 3 and 4 show a drainage valve 200 that is generally used with the spout 100. The drainage valve 200 is positioned within the aperture 130 of the spout 100. The drainage valve 200 generally includes a hollow tube 210, with a series of anchoring ribs 220 positioned about the tube 210. The anchoring ribs 220 anchor the drainage valve 200 within the aperture 130 of the spout 100. Drainage valve 200 also may include a handling flange 230. The handling flange 230 is used to assist in coupling the spout 100 to the hose of a post-mix dispenser (not shown) and to install or remove the drainage valve 200 from the spout 100. The handling flange 230 may be somewhat scalloped to permit easy grasping and use. The tube 210 also may include cap threads 240 so as to mate with a cap 250. Within the tube 210 is an internal valve 260 with a series of apertures 270 so as to control the flow of liquid through the spout 100. The drainage valve 200 is generally made from the same types of plastic material and in a similar manner as with the spout 100.

Figure 5:
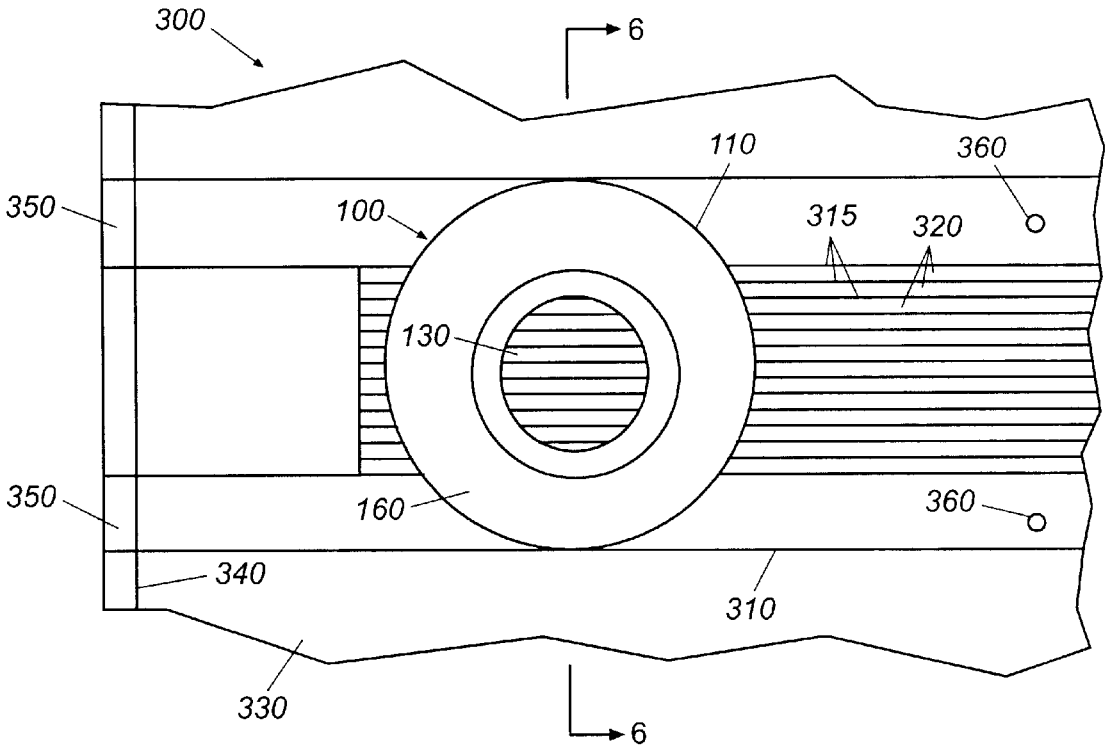
FIG. 5 is a partial cut-away view of a BIB bag with a ribbed dip strip and the spout of the present invention.
Figure 6:
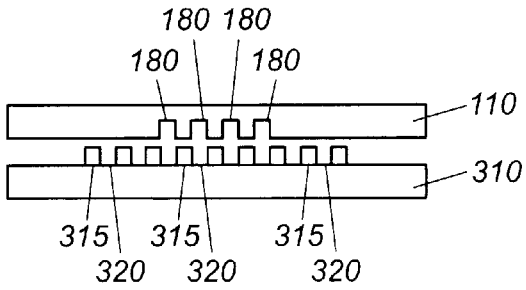
FIG. 6 is partial cross-sectional view of the ribbed dip strip and the flange of the spout of the present invention taken along line 6—6 of FIG. 5.

FIGS. 5 and 6 show the use of the spout 100 in a bag 300 for use in a bag-in-box package. The bag 300 includes a ribbed dip strip 310. The dip strip 310 includes plurality of ribs 315 that form a plurality of fluid passageways 320. The bag 300 further includes a pair of bag walls 330 joined together at a plurality of seams 340. One or more ends 350 of the dip strip 310 are preferably sealed within the seams 340. The dip strip 310 also may be connected to one of the bag walls 330 at one or more contact points 360. The preferred construction of the bag 300 is described in detail in commonly-owned Ser. No. 09/089,151, incorporated herein by reference. The spout 100 itself is joined to one of the bag walls 330 along the top side 160 of the flange 110. The spout 100 is joined to one of the bag walls 330 by heat sealing or by other conventional methods to form a substantially liquid tight seal.

In use, the evacuation channels 180 of the spout 100 insure that fluid can pass from the interior of the bag 300 through the flange 110 and out of aperture 130. The evacuation channels 180 of the spout 100 may be in communication with the fluid passageways 320 of the dip strip 310 so as to permit fluid to travel along the dip strip 310 and out of the spout 100 even as the bag 300 is collapsing.

Further, because the evacuation channels 180 encircle the spout 100, the evacuation channels 180 provide a plurality of fluid passageways through the spout 100 in any direction regardless of the orientation or position of the bag 300. Even as the bag 300 begins to collapse, the evacuation channels 180 permit fluid to pass through the flange 110 and out of the aperture 130. The evacuation channels 180 thus provide a fluid passageway to and through the spout 100 without the use of extended ribs or other structures that require additional materials and costs.

It should be understood that the foregoing relates only to the preferred embodiments of the present invention and that numerous changes may be made herein without departing from the spirit and scope of the invention as defined by the following claims.

We claim:

1. A spout for a wall of a flexible pouch, said spout comprising:

a substantially hollow tube; and a radial flange surrounding said substantially hollow tube;

said radial flange comprising a plurality of channels so as to provide a plurality of fluid passageways leading towards said substantially hollow tube wherein said flange comprises an inner diameter and an outer diameter and wherein each of said plurality of channels allows fluid to enter through the outer diameter of the flange and to exit through the inner diameter of the flange.

2. The spout of claim 1, wherein said flange comprises a first side and a second side and wherein said spout is attached to said wall of said flexible pouch along said first side of said flange.

3. The spout of claim 1, wherein said flange comprises a first side and a second side and wherein said plurality of channels is positioned along said second side of said flange.

4. The spout of claim 1, wherein said substantially hollow tube comprises a first end and a second end and wherein said flange is positioned at said second end of said tube.

5. The spout of claim 1, wherein said flange comprises an inner diameter and an outer diameter and wherein each of said plurality of channels extends radially from said outer diameter to said inner diameter of said flange.

6. The spout of claim 1, wherein each of said plurality of channels is positioned equidistantly around said flange.

7. The spout of claim 1, wherein said plurality of channels is formed within said flange.

8. The spout of claim 1, wherein said flange comprises a thermoplastic material.

9. The spout of claim 1, wherein said flange comprises a thickness of about 0.060 inches and each of said plurality of channels comprises a depth of about 0.030 inches.

10. The spout of claim 1, wherein said flange comprises approximately thirty (30) of said channels.

11. A bag for a bag-in-box package, said bag comprising:

a first and a second bag wall;

a dip strip positioned between said first and said second bag walls; and a spout positioned in said first bag wall;

said spout comprising an aperture and a radially extending flange;

said flange comprising a plurality of channels so as to provide a plurality of fluid passageways leading towards said aperture wherein said flange comprises an inner diameter and an outer diameter and wherein each of said plurality of channels allows fluid to enter through the outer diameter of the flange and to exit through the inner diameter of the flange.

12. The bag of claim 11, wherein said radially extending flange comprises a first side and a second side and wherein said spout is attached to said first bag wall along said first side of said flange.

13. The bag of claim 11, wherein said radially extending flange comprises a first side and a second side and wherein said plurality of channels is positioned along said second side of said flange.

14. The bag of claim 11, wherein said spout comprises a first end and a second end and wherein said flange is positioned at said second end of said spout.

15. The bag of claim 11, wherein said radially extending flange comprises an inner diameter and an outer diameter and wherein each of said plurality of channels extends radially from said outer diameter to said inner diameter of said flange.

16. The bag of claim 11, wherein said plurality of channels is formed within said radially extending flange.

17. The bag of claim 11, wherein each of said plurality of channels is positioned equidistantly around said flange.

18. The bag of claim 11, wherein said flange comprises a thermoplastic material.

19. The bag of claim 11, wherein said dip strip comprises a plurality of ribs thereon and wherein said plurality of channels of said radially extending flange faces said plurality of ribs of said dip strip.

20. A bag for a bag-in-box package, said bag comprising:

a first and a second bag wall;

a dip strip positioned between said first and said second bag walls; and a spout positioned in said first bag wall;

said spout comprising a radially extending flange with a first side and a second side such that said spout is attached to said first bag wall along said first side of said flange;

said second side of said radially extending flange comprising a plurality of radially extending channels formed therein wherein said flange comprises an inner diameter and an outer diameter and wherein each of said plurality of channels allows fluid to enter through the outer diameter of the flange and to exit through the inner diameter of the flange.

* * * * *